US011066783B2

(12) United States Patent
Ficyk

(10) Patent No.: US 11,066,783 B2
(45) Date of Patent: Jul. 20, 2021

(54) CORROSION RESISTANT CABLE

(71) Applicant: Leggett & Platt Canada Co., Halifax (CA)

(72) Inventor: Eugene John Ficyk, Livonia, MI (US)

(73) Assignee: LEGGETT & PLATT CANADA CO., Halifax (CA)

( * ) Notice: Subject to any disclaimer, the term of this patent is extended or adjusted under 35 U.S.C. 154(b) by 225 days.

(21) Appl. No.: 16/133,118

(22) Filed: Sep. 17, 2018

(65) Prior Publication Data

US 2020/0087855 A1 Mar. 19, 2020

(51) Int. Cl.

*E05F 11/48* (2006.01)
*D07B 1/06* (2006.01)
*D07B 1/16* (2006.01)

(52) U.S. Cl.

CPC ..... *D07B 1/0693* (2013.01); *D07B 1/0633* (2013.01); *D07B 1/162* (2013.01); *E05F 11/485* (2013.01); *D07B 2201/206* (2013.01); *D07B 2201/2011* (2013.01); *D07B 2201/2036* (2013.01); *D07B 2205/3046* (2013.01); *D07B 2205/3071* (2013.01); *D07B 2401/2025* (2013.01)

(58) Field of Classification Search

CPC ..... E05F 11/488; E05F 11/485; D02G 3/38; D02G 3/40; D07B 1/162; D07B 1/0693; D07B 1/0633; D07B 2801/12; D07B 2801/18; D07B 2801/14; D07B 2801/24; D07B 2205/3071; D07B 2205/3046; D07B 2401/2025; D07B 2201/206; D07B 2201/2011; D07B 2201/2036

See application file for complete search history.

(56) References Cited

U.S. PATENT DOCUMENTS

| | | | | |
|---|---|---|---|---|
| 3,778,994 | A | 12/1973 | Humphries | |
| 5,199,310 | A | 4/1993 | Yoshimura | |
| 5,475,973 | A | 12/1995 | Furukawa et al. | |
| 2005/0034375 | A1 | 2/2005 | Vanderbeken et al. | |
| 2008/0244981 | A1* | 10/2008 | Arimoto | E05F 11/385 49/352 |
| 2010/0031575 | A1* | 2/2010 | Kinoshita | E05F 11/485 49/352 |
| 2010/0223852 | A1* | 9/2010 | Arimoto | E05F 11/385 49/352 |
| 2013/0283697 | A1* | 10/2013 | Galliot | E05F 11/488 49/352 |
| 2014/0102007 | A1* | 4/2014 | Pavlovic | E05F 15/697 49/352 |

(Continued)

FOREIGN PATENT DOCUMENTS

| | | |
|---|---|---|
| KR | 200181481 Y1 | 5/2000 |
| WO | 2007071340 A1 | 6/2007 |

OTHER PUBLICATIONS

International Search Report and Written Opinion for Application No. PCT/IB2019/000957 dated Jan. 16, 2020 (9 pages).

*Primary Examiner* — Beth A Stephan
(74) *Attorney, Agent, or Firm* — Michael Best & Friedrich LLP

(57) ABSTRACT

A cable includes a core with a plurality of first wires made of carbon steel and a plurality of strands surrounding the core. Each strand includes a plurality of second wires made of stainless steel. The cable has a maximum cross-sectional dimension less than 2 millimeters.

20 Claims, 3 Drawing Sheets

(56) References Cited

U.S. PATENT DOCUMENTS

| | | | | |
|---|---|---|---|---|
| 2017/0145729 | A1* | 5/2017 | Hernandez-Urbina | E05F 15/695 |
| 2018/0334843 | A1* | 11/2018 | Fortin | E05F 11/382 |

* cited by examiner

CORROSION RESISTANT CABLE

BACKGROUND OF THE DISCLOSURE

The present disclosure relates to cables, and more particularly to cables for use in window regulator systems.

Metal cables used in automotive window regulator systems typically have high requirements for tensile strength, tight bend fatigue resistance, and corrosion resistance. In addition, these cables must be relatively thin (e.g., less than two millimeters in diameter or a maximum cross-sectional dimension) and flexible due to the limited space available inside a typical vehicle door panel.

Corrosion resistance is commonly measured in hours pursuant to American Society of Testing and Materials (ASTM) test B117. Under ASTM B117, test samples are placed in an enclosed chamber and exposed to a continuous spray of heavy salt water fog or mist. The test sample's measured corrosion resistance is the amount of time that elapses before the test sample begins to visibly corrode. Typical window regulator cables have a corrosion resistance under ASTM B117 between about 144 hours and about 312 hours. These cables are typically made of a bundle of galvanized carbon steel wires with a galvanized zinc coating and a lubricant that is applied between the wires as the cable is stranded. However, the zinc coating is relatively soft and can be easily damaged during assembly, shipping, and use, resulting in reduced performance.

It is desirable to provide a cable that is more resistant to corrosion than typical window regulator cables, but greater corrosion resistance generally competes with other requirements, such as thickness, tensile strength, and fatigue resistance. For example, cables made entirely of stainless steel have high corrosion resistance but lack sufficient tensile strength and fatigue resistance to be suitable for use as window regulator cables. In addition, the thickness of the zinc coating on galvanized carbon steel cables cannot be practically increased to provide corrosion resistance above 312 hours while staying within the cable's overall thickness, strength, and flexibility requirements.

Thus, a need exists for a cable with improved corrosion resistance that maintains sufficient strength, fatigue resistance and flexibility in a thickness suitable for use in automotive window regulator systems.

SUMMARY OF THE DISCLOSURE

In one aspect, the present disclosure provides a cable including a core with a plurality of first wires made of carbon steel and a plurality of strands surrounding the core. Each strand includes a plurality of second wires made of stainless steel. The cable has a maximum cross-sectional dimension less than 2 millimeters.

In another aspect, the present disclosure provides a cable including a core with a plurality of first wires, and a plurality of strands surrounding the core. Each strand includes a plurality of second wires. The cable defines a maximum cross-sectional dimension less than 2 millimeters and has a breaking strength of at least 2000 Newtons. In addition, the cable elastically elongates less than 1% of its total length and plastically elongates less than 0.05% of its total length under a tensile load of about 60% of the breaking strength. The cable has a corrosion resistance under ASTM B117 greater than 312 hours.

In another aspect, a window regulator system includes a track, a carriage coupled to the track for movement along the track, a window coupled to the carriage for movement with the carriage along the track, and a cable coupled to the carriage. The cable includes a core having a plurality of first wires made of carbon steel and a plurality of strands surrounding the core, each strand having a plurality of second wires made of stainless steel. The window regulator system also includes a motor coupled to the cable and operable to move the carriage along the track via the cable. The cable maximum cross-sectional dimension less than 2 millimeters, and the cable has a breaking strength of at least 2000 Newtons.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

DETAILED DESCRIPTION

Figure 1:
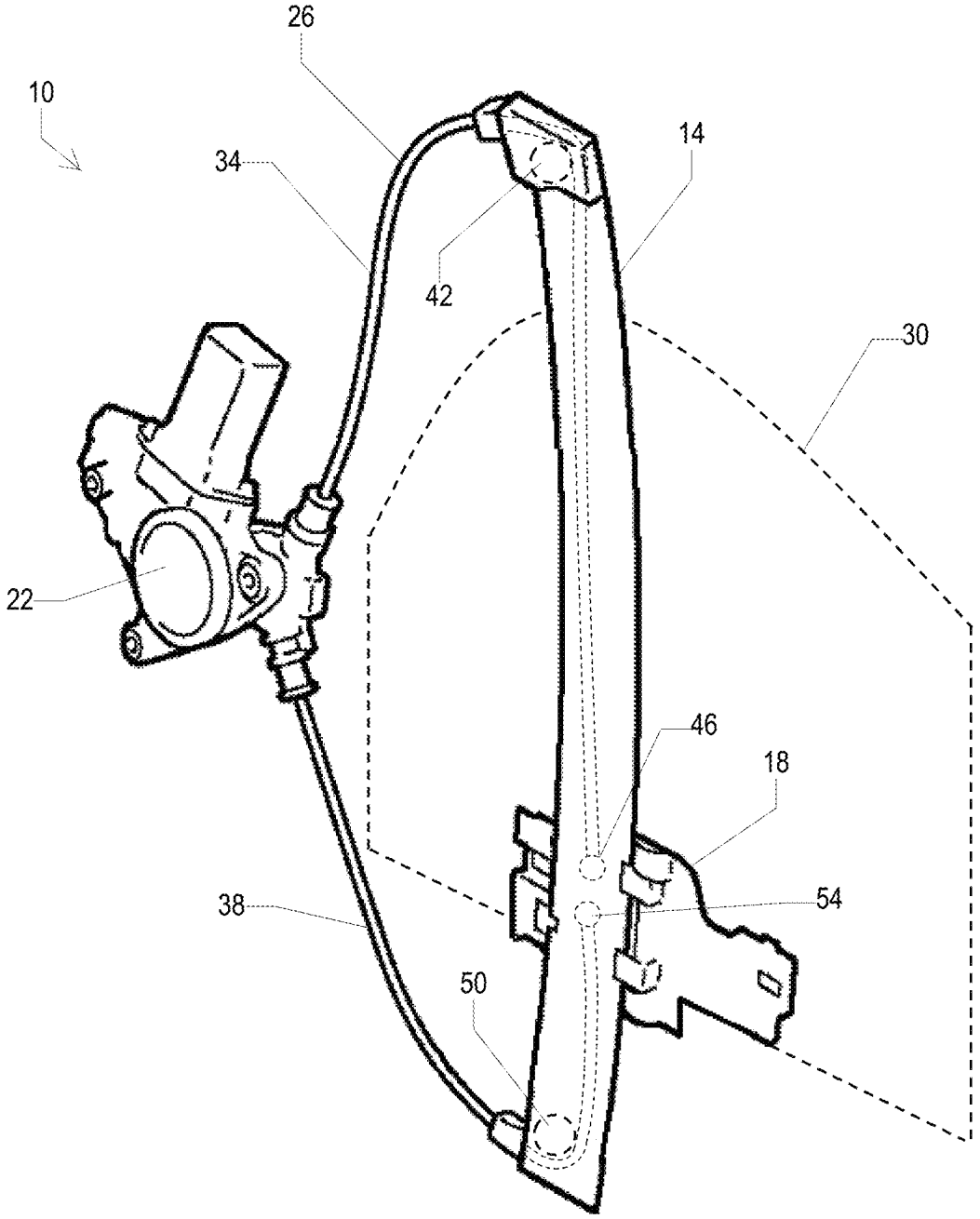
FIG. 1 is a perspective view of a window regulator system in which a cable embodying aspects of the present disclosure may be implemented.

FIG. 1 illustrates a window regulator system 10 including a track 14, a carriage 18, a motor 22, and a cable 26. A window 30 is fixed to the carriage 18, and the carriage 18 is movable along the track 14 (in response to operation of the motor 22) to raise and lower the window 30. The cable 26 interconnects the motor 22 with the carriage 18. In the illustrated embodiment, the cable 26 is arranged in a single loop, with a first section 34 and a second section 38 extending in generally opposite directions from the motor 22. The first section 34 is routed over a first pulley 42, which redirects the first section 34 of the cable 26 down along the track 14. The first section 34 terminates at a distal end 46, which is fixed to the carriage 18. The second section 38 is routed over a second pulley 50, which redirects the second section 38 up along the track 14. The second section 38 terminates at a distal end 54, which is likewise fixed to the carriage 18. In other embodiments, the cable 26 may be arranged or routed in other ways (e.g., in a figure eight pattern), using any number of pulleys or other cable routing means. In some embodiments, the cable 26 may be housed within a sleeve.

In use, the motor is driven in a first direction to draw the first section 34 of the cable 26 toward the motor 22 while the second section 38 moves away from the motor 22. This moves the carriage 18 up along the track 14, thereby raising the window 30. The motor 22 is reversed to draw the second section 38 of the cable 26 toward the motor 22 while the first section 34 moves away from the motor 22. This moves the carriage 18 down along the track 14 and thereby lowers the window 30.

Figure 2:
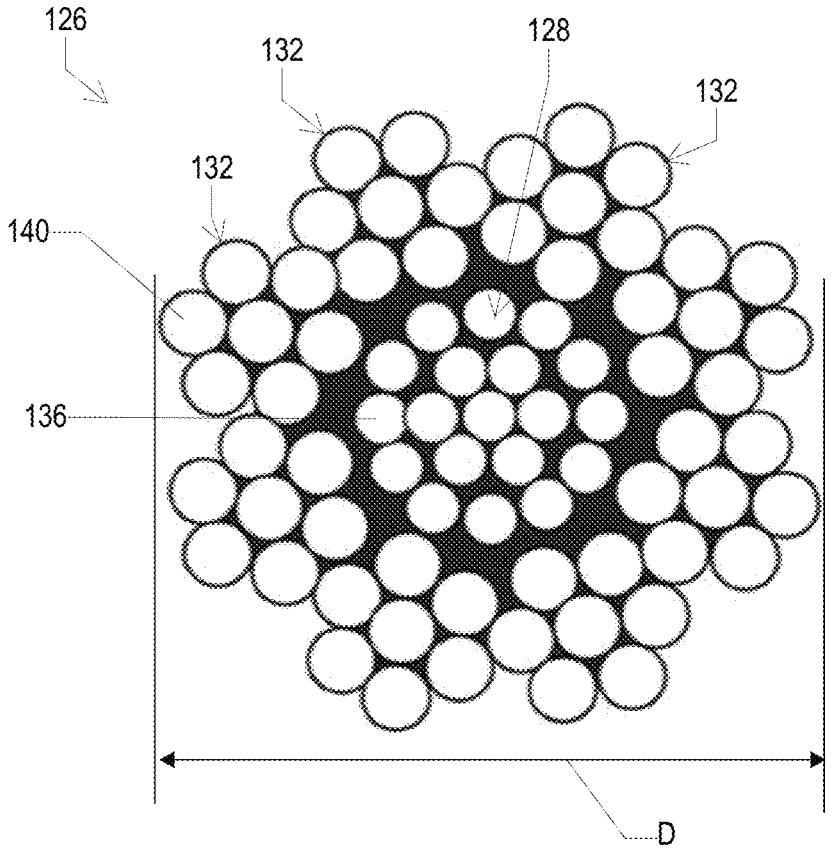
FIG. 2 is a cross-sectional view of a cable according to one embodiment of the disclosure.

FIG. 2 illustrates a cable 126 according to one embodiment of the disclosure. The cable 126 is usable with a window regulator system (e.g., as the cable 26 of the window regulator system 10 of FIG. 1). It should be understood, however, that the cable 126 may also be advantageously used in other applications. For example, the cable 126 may be used as a cinch cable or in other automotive or non-automotive applications in which high strength, fatigue resistance, and corrosion resistance are desirable.

The illustrated cable 126 includes a core 128 and a plurality of strands 132 surrounding and wrapped around the core 128. The core 128 includes a plurality of first wires 136, and each of the strands 132 includes a plurality of second wires 140. In the illustrated embodiment, the core includes nineteen first wires 136, and the cable 126 includes eight strands 132, each with seven second wires 140. In other embodiments, the number of first wires 136, strands 132, and/or second wires 140 may vary. The cable 126 has a maximum cross-sectional dimension D that is less than two millimeters, such that the cable 126 is thin enough to be suitable for use in a window regulator system. In the illustrated embodiment, the dimension D of the cable 126 is about 1.5 millimeters. As used in the context of the dimension D, the word "about" means within a tolerance of +0.05 millimeters.

With continued reference to FIG. 2, the first wires 136 are made of galvanized carbon steel. For example, the first wires 136 may be made of Type 60B carbon steel having a carbon content between 0.4% and 0.9% by weight, and the first wires 136 may be galvanized with zinc at a coating weight of at least 15 grams per square meter. The second wires 140 are made of uncoated stainless steel. For example, the second wires 140 may be made of SAE 304 series stainless steel. Alternatively, other types of austenitic stainless steel may be used. As used herein, the word "uncoated" means that there is no coating bonded to the individual second wires 140. However, there may be lubricant on the second wires 140, and the cable 126 may be entirely covered in a sleeve or jacket. In the illustrated embodiment, the core 128 includes a plastic coating surrounding the first wires 136. The plastic coating may be polyamide, polyethylene, or any other plastic material suitable for forming a vapor barrier between the core 128 and the surrounding strands 132. The plastic coating may be applied to the individual first wires 136 of the core 128 during assembly of the core 128 (e.g., extruded over the individual wires 136), or the entire core 128 may be coated.

The stainless steel strands 132 have higher corrosion resistance than the core 128 and therefore protect the core 128 from corrosion. The plastic coating forms a vapor barrier between the core 128 and the strands 132 to inhibit infiltration of moisture into the core 128, which further improves the corrosion resistance of the cable 126. The carbon steel material of the core 128 is stronger (i.e. has a higher tensile strength) and more fatigue resistant than the stainless steel material of the strands 132.

Figure 3:
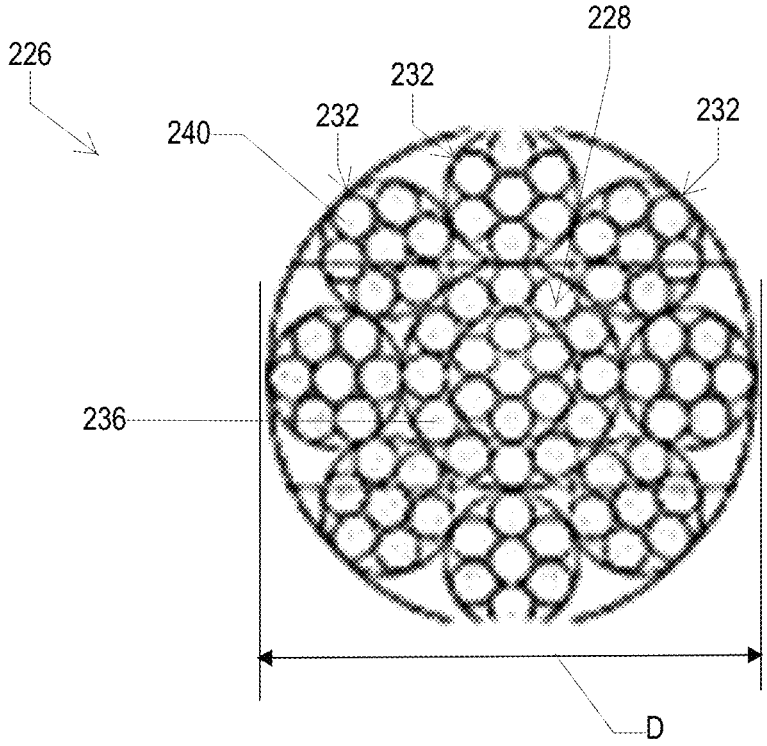
FIG. 3 is a cross-sectional view of a cable according to another embodiment of the disclosure.

FIG. 3 illustrates a cable 226 according to another embodiment of the disclosure. Like the cable 126 of FIG. 2, the cable 226 of FIG. 3 is usable with the window regulator system 10 of FIG. 1 but may also be advantageously used in other applications. The cable 226 is similar to the cable 126, and features and elements of the cable 226 corresponding with features and elements of the cable 126 are given like reference numbers plus '100.'

The illustrated cable 226 includes a core 228 and a plurality of strands 232 surrounding and wrapped around the core 228. The core 228 includes a plurality of first wires 236, and each of the strands 232 includes a plurality of second wires 240. In the illustrated embodiment, the core includes nineteen first wires 236, and the cable 226 includes eight strands 232, each with seven second wires 240. In other embodiments, the number of first wires 236, strands 232, and/or second wires 240 may vary. The first wires 236 are made of carbon steel. For example, the first wires 236 may be made of Type 60B carbon steel having a carbon content between 0.4% and 0.9% by weight. In some embodiments, the first wires 236 may be galvanized with a zinc and aluminum coating surrounding each individual wire 236 at a coating weight of at least 15 grams per square meter. Alternatively, the first wires 236 may include a zinc and nickel coating surrounding each individual wire 236. The second wires 240 are made of uncoated stainless steel. For example, the second wires 240 may be made of SAE 304 series stainless steel. Alternatively, other types of austenitic stainless steel may be used. The core 228 does not include a plastic coating like the core 128 of the cable 126. The cable 226 has a maximum cross-sectional dimension D that is less than two millimeters, such that the cable 226 is thin enough to be suitable for use in a window regulator system. In the illustrated embodiment, the dimension D of the cable 226 is about 1.5 millimeters.

The stainless steel strands 232 have higher corrosion resistance than the core 228 and therefore protect the core 228 from corrosion. The zinc and nickel coating on each of the first wires 236 protects the core 228 from any moisture that may infiltrate between the strands 232. The carbon steel material of the core 228 is stronger (i.e. has a higher tensile strength) and more fatigue resistant than the stainless steel material of the strands 232.

Experimental testing was performed on the cables 126, 226, which confirmed that the cables 126, 226 have corrosion resistance superior to that of typical window regulator cables. The cables 126, 226 were tested for durability (i.e. fatigue resistance), breaking strength, corrosion resistance, elastic elongation, and plastic elongation. To test durability, the cables 126, 226 were subjected to a tensile load of 160 Newtons (N) and moved back and forth a travel distance of 200 mm, six times (or cycles) per minute. The number of cycles before failure was recorded. To test breaking strength, the cables 126, 226 were subjected to a tensile load that gradually increased until failure. Corrosion resistance was tested according to the procedures set forth in ASTM B117. Elastic elongation (or elasticity) was tested by applying a tensile load of 1560 N to the cables 126, 226 and measuring an elastic elongation of the cable 126, 226 as a percentage of the starting length (i.e. before loading) of each cable 126, 226. Plastic elongation (or plasticity) was tested by removing the tensile load of 1560 N from the cables 126, 226 and measuring the difference between the starting length of each cable 126, 226 and ending length (i.e. after unloading) of each cable 126, 226, as a percentage of the starting length of each cable 126, 226. These test results are summarized in Table 1 below:

TABLE 1

Cable Experimental Test Data

| | Cable 126 | Cable 226 |
|---|---|---|
| Durability Cycles | 13,063 | 13,666 |
| Minimum Breaking Strength | 2,532 N | 2,599 N |
| Corrosion Resistance (per ASTM B117) | 1,000 hrs. | 600 hrs. |
| Elastic Elongation (1560 N tensile load) | 0.86% | 0.91% |
| Plastic Elongation (1560 N tensile load) | 0.04% | 0.03% |

As evident from the data in Table 1, both the cables 126 and 226 have a minimum breaking strength greater than 2,000 N, and in some embodiments greater than 2,500 N.

The data in Table 1 also demonstrates that both the cables 126 and 226 have a fatigue resistance greater than 13,000 durability cycles. In addition, each of the cables 126, 226 elastically elongates less than 1% of its total length under a tensile load of about 60% of the breaking strength of the respective cable 126, 226, and each of the cables 126, 226 plastically elongates less than 0.05% of its total length under a tensile load of about 60% of the breaking strength of the respective cable 126, 226. Finally, the cable 126 demonstrated a corrosion resistance of 1,000 hours under ASTM B117, and the cable 226 demonstrated a corrosion resistance of 600 hours under ASTM B117.

Various features of the disclosure are set forth in the following claims.

What is claimed is:

1. A cable comprising:

a core including a plurality of first wires made of carbon steel; and a plurality of strands surrounding the core, each strand including a plurality of second wires made of stainless steel, wherein the cable has a maximum cross-sectional dimension less than 2 millimeters, and wherein the cable has a breaking strength of at least 2000 Newtons.

2. The cable of claim 1, wherein the cable has a corrosion resistance under ASTM B117 greater than 312 hours.

3. The cable of claim 1, wherein the cable has a corrosion resistance under ASTM B117 between 600 hours and 1,000 hours.

4. The cable of claim 1, wherein the plurality of first wires includes nineteen first wires.

5. The cable of claim 1, wherein the plurality of second wires includes seven second wires.

6. The cable of claim 1, wherein each of first wire of the plurality of first wires includes a zinc and nickel coating, and wherein each wire of the plurality of second wires is uncoated.

7. The cable of claim 6, wherein the core includes a plastic moisture barrier surrounding each first wire of the plurality of first wires.

8. The cable of claim 1, wherein the plurality of strands includes eight strands.

9. The cable of claim 1, wherein the cable elastically elongates less than 1% of its total length and plastically elongates less than 0.05% of its total length under a tensile load of about 60% of a breaking strength of the cable.

10. The cable of claim 1, wherein the breaking strength is at least 2,500 Newtons.

11. A cable comprising:

a core including a plurality of first wires; and a plurality of strands surrounding the core, each strand including a plurality of second wires, wherein the plurality of first wires includes nineteen first wires, wherein the plurality of second wires includes seven second wires, and wherein the plurality of strands includes eight strands, wherein the cable defines a maximum cross-sectional dimension less than 2 millimeters, wherein the cable has a breaking strength of at least 2000 Newtons, wherein the cable elastically elongates less than 1% of its total length and plastically elongates less than 0.05% of its total length under a tensile load of about 60% of the breaking strength, and wherein the cable has a corrosion resistance under ASTM B117 greater than 312 hours.

12. The cable of claim 11, wherein the cable has a corrosion resistance under ASTM B117 between 600 hours and 1,000 hours.

13. The cable of claim 11, wherein each first wire of the plurality of first wires is made of carbon steel with a zinc and nickel coating, and wherein each second wire of the plurality of second wires is made of uncoated stainless steel.

14. The cable of claim 11, wherein the core includes a plastic moisture barrier.

15. The cable of claim 11, wherein the maximum cross-sectional dimension of the cable is about 1.5 millimeters.

16. A window regulator system comprising:

a track;

a carriage coupled to the track for movement along the track;

a window coupled to the carriage for movement with the carriage along the track;

a cable coupled to the carriage, the cable including a core having a plurality of first wires made of carbon steel, and a plurality of strands surrounding the core, each strand having a plurality of second wires made of stainless steel; and a motor coupled to the cable and operable to move the carriage along the track via the cable, wherein the cable has a maximum cross-sectional dimension less than 2 millimeters, and wherein the cable has a breaking strength of at least 2000 Newtons.

17. The window regulator system of claim 16, wherein the cable has a corrosion resistance under ASTM B117 greater than 312 hours.

18. The window regulator system of claim 16, wherein the plurality of first wires includes nineteen first wires, wherein the plurality of second wires includes seven second wires, wherein the plurality of strands includes eight strands, and wherein each second wire of the plurality of second wires is uncoated.

19. The window regulator system of claim 18, wherein the core includes a plastic moisture barrier.

20. The window regulator system of claim 16, wherein the breaking strength is at least 2,500 Newtons.

* * * * *